US008079147B2

(12) United States Patent
Wonderley

(10) Patent No.: US 8,079,147 B2
(45) Date of Patent: Dec. 20, 2011

(54) SHAVING SYSTEM

(75) Inventor: Jeffrey W. Wonderley, Fort Defiance, VA (US)

(73) Assignee: American Safety Razor, Verona, VA (US)

( * ) Notice: Subject to any disclaimer, the term of this patent is extended or adjusted under 35 U.S.C. 154(b) by 399 days.

(21) Appl. No.: 12/394,768

(22) Filed: Feb. 27, 2009

(65) Prior Publication Data

US 2009/0235539 A1 Sep. 24, 2009

Related U.S. Application Data

(60) Provisional application No. 61/031,888, filed on Feb. 27, 2008.

(51) Int. Cl.
*B26B 21/22* (2006.01)
*B26B 21/52* (2006.01)

(52) U.S. Cl. ..... 30/47; 30/50; 30/527; 30/532

(58) Field of Classification Search ..... 30/47, 50, 30/526, 527, 532
See application file for complete search history.

(56) References Cited

U.S. PATENT DOCUMENTS

| | | | | |
|---|---|---|---|---|
| 3,644,992 | A | 2/1972 | Bennett et al. | |
| 4,428,116 | A | 1/1984 | Chen et al. | |
| 4,599,793 | A * | 7/1986 | Iten | 30/47 |
| 5,107,590 | A * | 4/1992 | Burout et al. | 30/526 |
| 5,918,369 | A * | 7/1999 | Apprille et al. | 30/47 |
| 5,956,851 | A | 9/1999 | Apprille, Jr. et al. | |
| 6,026,577 | A * | 2/2000 | Ferraro | 30/526 |
| 6,192,586 | B1 * | 2/2001 | Metcalf et al. | 30/47 |
| 7,770,294 | B2 * | 8/2010 | Bruno et al. | 30/50 |
| 2004/0103545 | A1 * | 6/2004 | Dansreau | 30/526 |
| 2007/0193042 | A1 * | 8/2007 | Worrick et al. | 30/527 |
| 2008/0110034 | A1 * | 5/2008 | Schnak et al. | 30/526 |

FOREIGN PATENT DOCUMENTS

| | | |
|---|---|---|
| EP | 1 488 894 A1 | 12/2004 |
| EP | 1 488 894 B1 | 7/2007 |
| WO | WO 2006/086314 A1 | 8/2006 |
| WO | WO 2006/127435 A1 | 11/2006 |

OTHER PUBLICATIONS

European Search Report issued in European Patent Application No. 09716166.5-2313, mailed Feb. 24, 2011.

International Search Report and the Written Opinion of the International Searching Authority issued in International Patent Application No. PCT/US2009/035462 dated May 21, 2009.

* cited by examiner

*Primary Examiner* — Hwei C Payer
(74) *Attorney, Agent, or Firm* — McDermott Will & Emery LLP

(57) ABSTRACT

A shaving system having replaceable blade cartridges is provided with a simple connector for pivotably mounting the cartridge, and for attaching to a handle with a simple latch mechanism. Embodiments include a handle having a handle body, and a connector mounting portion at the front of the handle body with a substantially horizontal bottom wall and an inwardly-extending, elastically deformable cantilever latch. The connector has a cartridge mounting structure, and a handle attachment portion extending rearward from a central body. The handle attachment portion has an extension for slidingly mating with the bottom wall of the handle's connector mounting portion, and a substantially vertical connector wall for engaging and deflecting the cantilever latch upward as the extension is slidingly engaged with the bottom wall, until an engagement portion of the cantilever latch snaps over the connector wall to removably retain the connector on the handle between bottom wall of the handle connector mounting portion and the cantilever latch.

20 Claims, 7 Drawing Sheets

SHAVING SYSTEM

RELATED APPLICATION

The present invention claims priority of provisional patent application No. 61/031,888 filed Feb. 27, 2008, the contents of which are incorporated herein in their entirety.

TECHNICAL FIELD

The present disclosure relates to shaving razors. The present disclosure has particular applicability to shaving razors having replaceable blade-carrying cartridges.

BACKGROUND

This disclosure relates to safety razors having a blade unit assembly carried by a handle and including at least one blade with a cutting edge which is moved across the surface of the skin being shaved using the handle. The blade unit can be detachably mounted on the razor handle to enable the blade unit to be replaced by a fresh blade unit when the blade becomes dull from use, or it may be fixedly attached to the handle with the intention that the entire razor be discarded when the blade or blades become dulled. Detachable and replaceable blade units are commonly referred to as razor cartridges.

Some conventional detachably mounted razor cartridges include an interconnect member having a pivotal support structure that pivotally supports the cartridge's blade housing, and also has a base structure adapted to be removably and fixedly attached to the head of the razor handle. The base structure typically comprises a latch mechanism which cooperates with a corresponding latch mechanism of the handle to releasably retain the interconnect on one end of the handle. The handle typically includes an ejector mechanism for interacting with the interconnect for facilitating removal of the base structure from the handle when the latch is operated to remove the razor cartridge from the handle.

Additionally, most conventional shaving razor systems have handle heads or interconnects configured to permit rotation of a replaceable razor cartridge about a pivot point. For example, some arrangements permit free rotation of the razor cartridge through a predetermined range about pins or bearings attached to the head and engaging an underside of the razor cartridge.

Some handle heads and/or interconnects spring-load or bias the pivotally mounted razor cartridge toward a neutral position, such as at or near the midpoint of the predetermined range, allowing the cartridge to be displaced away from the neutral position in one direction, and to then move back to the neutral position, using complicated spring configurations or requiring unique or specialized razor cartridges. Still other handle heads and interconnects have complex spring assemblies which extend from within the handle head to the front of the handle and contact the underside of the pivotally mounted razor cartridge to bias the cartridge to a "home" position.

Conventional razor cartridge mounting arrangements require a complex handle head, a complex razor cartridge, or both. There is a need for a simplified, inexpensive apparatus and methodology for mounting a conventional razor cartridge on a handle.

SUMMARY OF THE DISCLOSURE

An advantage of the present disclosure is a shaving system with a simple connector for pivotally mounting a razor cartridge, and for attaching to a handle with a simple latch mechanism.

According to the present disclosure, the foregoing and other advantages are achieved in part by a shaving system comprising a handle, a razor cartridge comprising at least one razor blade, and a connector. The handle has a handle body and a connector mounting portion at the front of the handle body, the connector mounting portion having a substantially horizontal bottom wall and an inwardly-extending cantilever latch that is elastically deformable in a substantially vertical direction, the cantilever latch including a protruding engagement portion. The connector comprises a central body, a cartridge mounting structure extending forward from the central body for supporting the razor cartridge, and a handle attachment portion extending rearward from the central body. The handle attachment portion has an extension for slidingly mating with the bottom wall of the connector mounting portion of the handle, and a substantially vertical connector wall for engaging and deflecting the cantilever latch upward as the extension is slidingly engaged with the bottom wall, until the engagement portion of the cantilever latch snaps over the connector wall to removably retain the connector on the handle between bottom wall of the handle connector mounting portion and the cantilever latch.

A further advantage of the present disclosure is a connector for supporting a razor cartridge, and for connecting to a handle having a handle body and a connector mounting portion at the front of the handle body, the connector mounting portion having a substantially horizontal bottom wall and an inwardly-extending cantilever latch that is elastically deformable in a substantially vertical direction, the cantilever latch including a protruding engagement portion. The connector comprises a central body, a cartridge mounting structure extending forward from the central body for supporting the razor cartridge, and a handle attachment portion extending rearward from the central body. The handle attachment portion has an extension for slidingly mating with the bottom wall of the connector mounting portion of the handle, and a substantially vertical connector wall for engaging and deflecting the cantilever latch upward as the extension is slidingly engaged with the bottom wall, until the engagement portion of the cantilever latch snaps over the connector wall to removably retain the connector on the handle between bottom wall of the handle connector mounting portion and the cantilever latch.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Conventional methodologies for attaching a pivoting razor cartridge to a handle and biasing the cartridge require complex handle heads and/or cartridges, which increases the cost of the shaving system. The present disclosure addresses and solves these problems stemming from conventional complex shaving systems.

According to the present disclosure, a single-piece connector attaches to a handle having a minimum number of moving parts, and also pivotally mounts a razor cartridge and biases the razor cartridge to a home position using springs integrally formed with the connector.

Figure 1A:
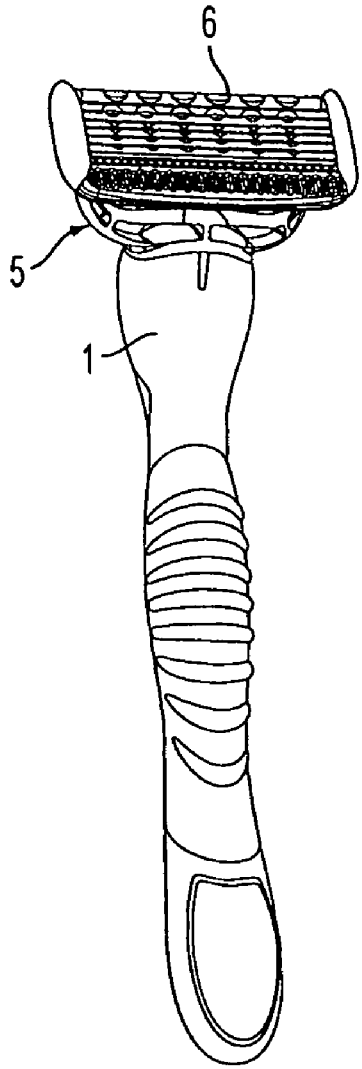
FIGS. 1*a-b* are perspective views of the disclosed handle and connector/cartridge assembly.
Figure 1B:
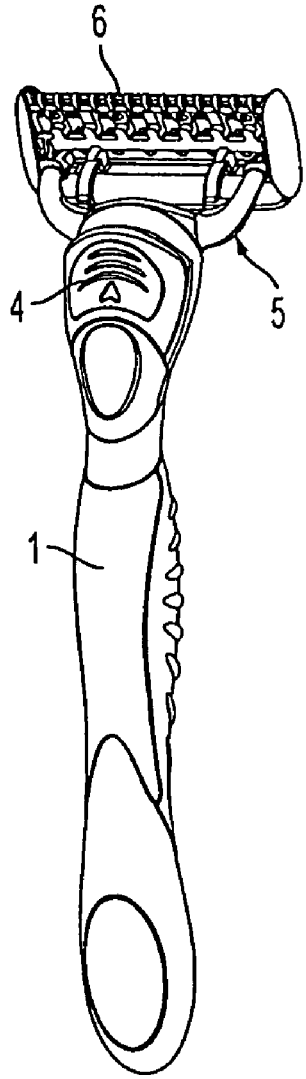

The disclosed shaving system, as shown in FIGS. 1*a-b*, includes a connector 5 which removably mounts to a razor handle 1. A razor cartridge 6, such as a five-blade cartridge whose blades are conventionally mounted using a sandwich construction, is pivotally mounted to connector 5.

The pivotal mounting of cartridge 6 to connector 5 will now be described with reference to FIGS. 6*a-d*. Connector 5 has a central body 5*e* and a pair of yokes 5*f* extending forward from body 5*e* to form a cartridge mounting structure. Each yoke 5*f* has a boss 5*g* at its distal end comprising; for example, a pair of opposed bearing sections (not shown) for rotatably supporting one of a pair of platform connector yokes (not shown) extending from a bottom platform of cartridge 6. The connector yokes snap into place between the bearing sections of bosses 5*g* by a slight flexing of yokes 5*f* towards each other. Of course, the position of the connector yokes and bearing sections could be reversed (i.e., the connector yokes could be formed on the yokes 5*f* and the bearing sections on the cartridge 6).

Each yoke 5*f* further comprises a cartridge return spring 5*h*. When cartridge 6 is mounted on connector 5 via the pivot pins bearing sections, springs 5*h* bear against a surface of the cartridge platform to bias cartridge 6 downward against a pair of rearward stops (not shown). The rearward stops provide a "home" position for cartridge 6 by preventing further downward cartridge pivoting. When cartridge 6 is pivoted upward, as in response to shaving forces, springs 5*h* flex upward to provide controlled movement of cartridge 6, then force cartridge 6 back to the home position as the shaving forces are lessened or removed. Forward stops (not shown) limit upward pivoting of cartridge 6.

An exemplary cartridge for use with the disclosed shaving razor is described in detail in copending U.S. patent application Ser. No. 12/249,700, filed Oct. 10, 2008, the disclosure of which is hereby incorporated by reference in its entirety.

Figure 2A:
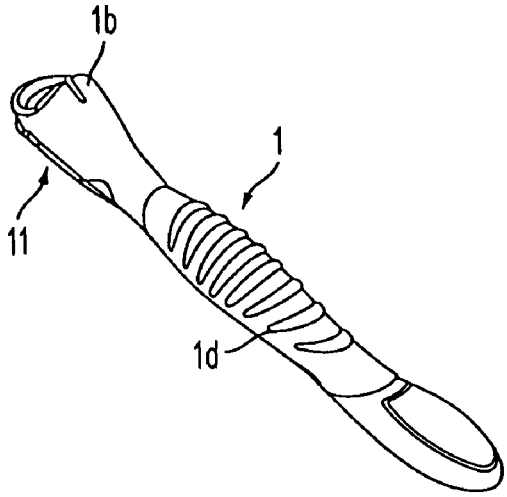
FIGS. 2*a-c* are bottom perspective, bottom, and front views, respectively, of the disclosed handle.
Figure 2B:
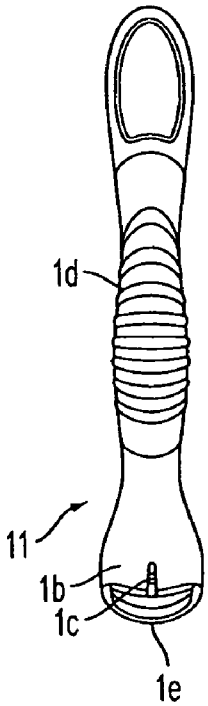
Figure 2C:
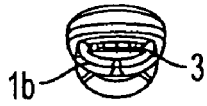
Figure 3A:
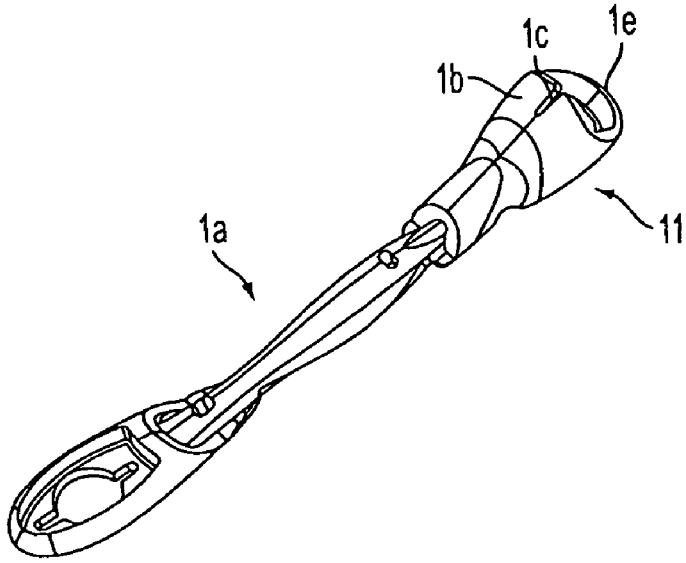
FIGS. 3*a-b* are bottom perspective and side views, respectively, of the handle frame of the disclosed handle.
Figure 3B:
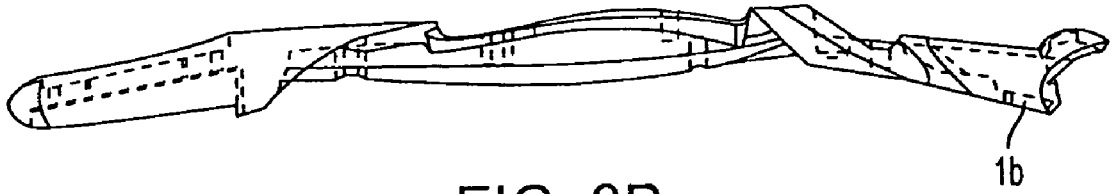
Figure 4A:
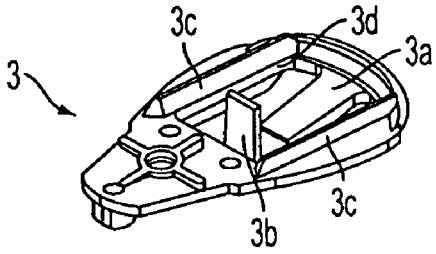
FIGS. 4*a-c* are rear perspective, top, and cross-sectional views, respectively, of the latch of the disclosed handle.
Figure 4B:
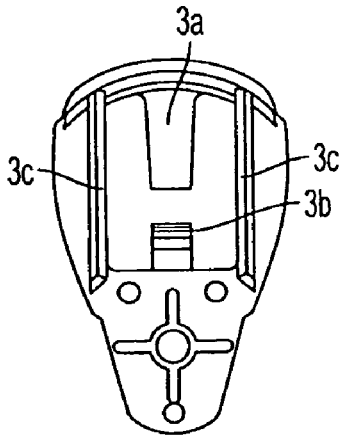
Figure 4C:
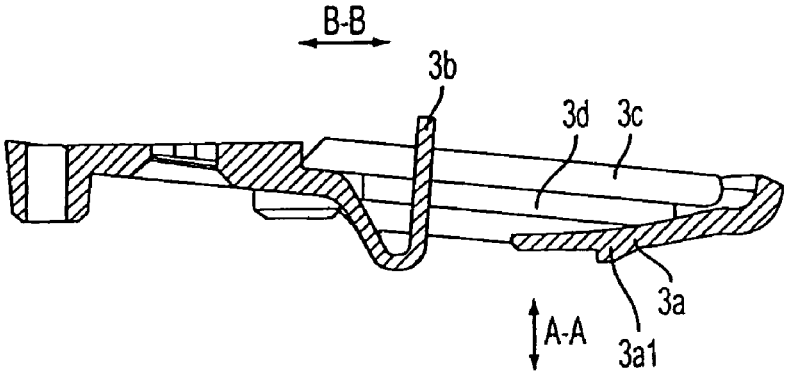
Figure 5A:
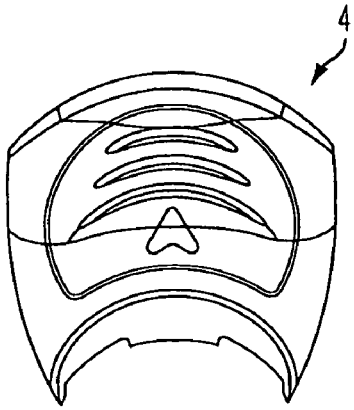
FIGS. 5*a-d* are top, rear, bottom, and cross-sectional views, respectively, of the button of the disclosed handle.
Figure 5B:
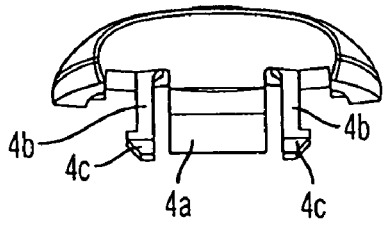
Figure 5C:
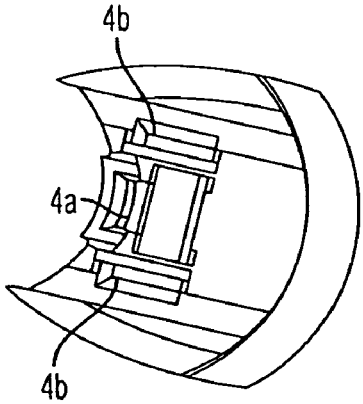
Figure 5D:
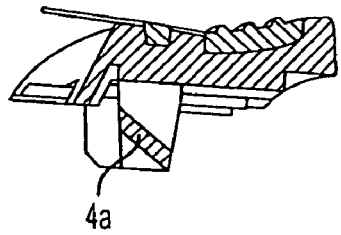
Figure 6B:
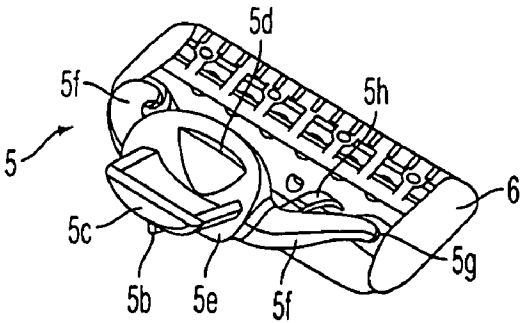
FIGS. 6*a-d* are front perspective, rear perspective, side, and top views, respectively, of the disclosed interconnect/cartridge.
Figure 6D:
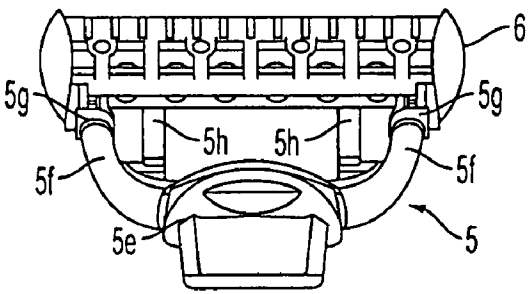
Figure 6A:
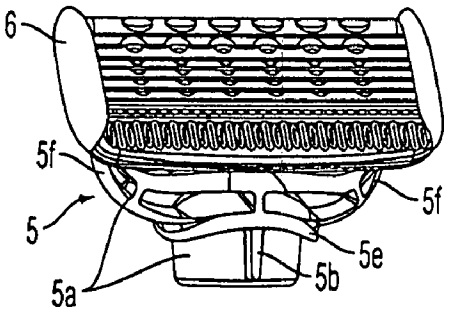
Figure 6C:
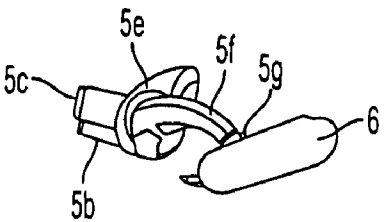

The disclosed structure for connecting and disconnecting a replaceable shaving razor cartridge to a razor will now be described with reference to FIGS. 2*a*-7. Handle 1 has a handle frame 1*a* (see FIG. 3*a*) whose front end has a connector mounting portion 11 with a substantially horizontal curved bottom wall 1*b*. In certain embodiments, as shown in FIGS. 2*a-b*, an elastomeric grip 1*d* is attached to handle frame 1*a* in a conventional manner. A latch 3, as shown in FIGS. 4*a-c*, is rigidly attached to handle frame 1*a* via a screw 2 and mating surfaces of the latch 3 and handle frame 1*a* (see FIG. 7). Latch 3 includes an inwardly-extending cantilever latch 3*a* that is elastically deformable and flexes in a substantially up-down (vertical) direction, as shown by the arrows A-A in FIG. 4*c*, and a substantially vertical cantilever-type button return spring 3*b* which flexes in a fore-aft (horizontal) direction, as shown by the arrows B-B in FIG. 4*c*. Cantilever latch 3*a* has a protruding engagement portion 3*a*1, whose function will be described below.

Figure 7:
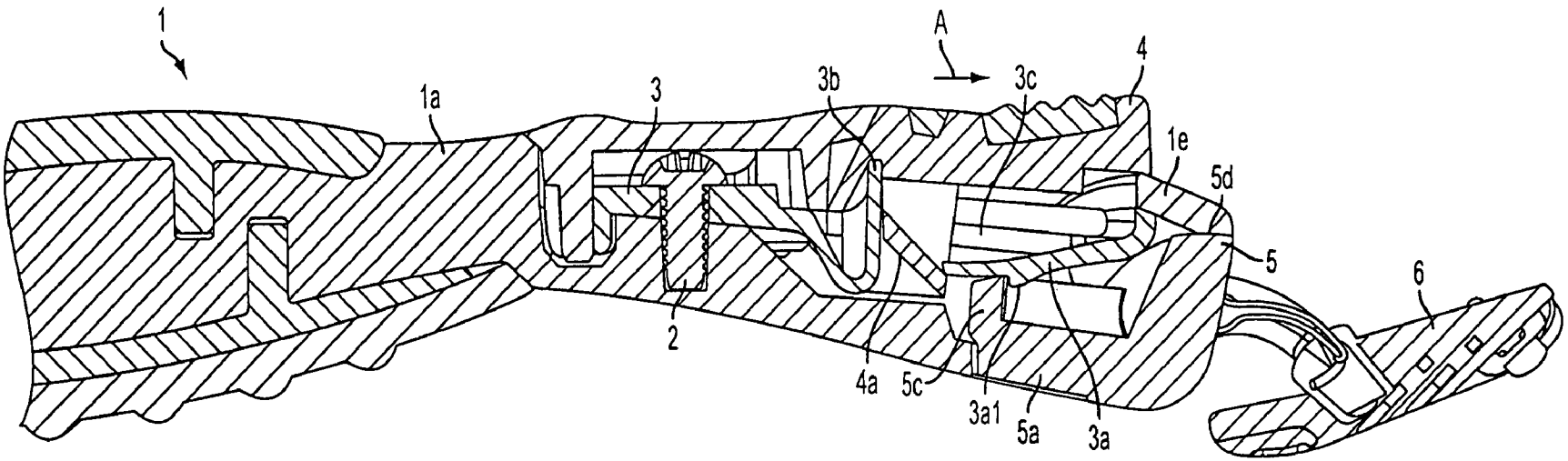
FIG. 7 is a cross-sectional view of the disclosed handle and connector/cartridge assembly.

Referring now to FIGS. 6*a-d*, connector 5 (which pivotably carries razor cartridge 6) has a substantially horizontal extension 5*a*, extending rearward from the central body 5*e*, that acts as a handle attachment portion. Extension 5*a* slides into the open front of handle frame 1*a* and is curved to mate with curved bottom wall 1*b*. Extension 5*a* has a raised rib 5*b* that fits into a slot 1*c* in curved bottom wall 1*b* to guide the connector 5 onto the handle frame 1*a*, and to stabilize the connector 5 on the handle 1. Extension 5*a* also has a substantially vertical connector wall 5*c* at its extreme rear end which engages and pushes up cantilever latch 3*a* as the connector 5 is slid into the connector mounting portion 11 of handle frame 1*a*, until the engagement portion 3*a*1 of cantilever latch 3*a* snaps over the connector wall 5*c* to retain the connector 5 on the handle 1, as shown in FIG. 7. A central portion 5*d* of the connector 5 stabilizes the connector 5 on the handle 1 by bearing against an upper front portion 1*e* of handle frame 1*a* opposed to bottom wall 1*b*. In certain embodiments, upper front portion 1*e* and central portion 5*d* of connector 5 are both curved.

A release button 4, as shown in FIGS. 5*a-d*, slides on tracks 3*c* of the latch 3 (see FIGS. 4*a-c*), and fits over button return spring 3*b* such that it is biased towards the rearmost part of tracks 3*c*. A ramp-like unlatch cam 4*a* of the button 4, best seen in FIGS. 5*b-d*, engages the rear and bottom surface of cantilever latch 3*a*, as shown in FIG. 7, such that when the button 4 is slid forward in the direction of arrow A by the user, unlatch cam 4*a* pushes against cantilever latch 3*a* to raise cantilever latch 3*a* above the connector wall 5*c* of connector 5, allowing the connector 5 to slide off the connector mounting portion 11. The button return spring 3*b* causes the button 4 to return to its initial position after the user releases the button 4. Button 4 has a pair of guides 4*b* for engaging the tracks 3*c*, and a pair of retaining tabs 4*c* for engaging grooves 3*d* on the underside of tracks 3*c* to retain button 4 on latch 3.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

What is claimed is:

1. A shaving system comprising:

a handle having a handle body and a connector mounting portion at the front of the handle body, the connector mounting portion having a substantially horizontal bottom wall and an inwardly-extending cantilever latch that is elastically deformable in a substantially vertical direction, the cantilever latch including a protruding engagement portion;

a razor cartridge comprising at least one razor blade; and a connector comprising:

a central body, a cartridge mounting structure extending forward from the central body for supporting the razor cartridge, and a handle attachment portion extending rearward from the central body, the handle attachment portion having an extension for slidingly mating with the bottom wall of the connector mounting portion of the handle, and the handle attachment portion further having a substantially vertical connector wall at its free end for engaging and deflecting the cantilever latch upward as the extension is slidingly engaged with the bottom wall, until the engagement portion of the cantilever latch snaps over the connector wall to removably retain the connector on the handle between the bottom wall of the connector mounting portion and the cantilever latch, and wherein at least a portion of the cantilever latch is concealed by the connector which forms a part of the external surfaces of the shaving system.

2. The shaving system of claim 1, wherein the cartridge mounting structure comprises a pair of yokes extending forward from the central body of the connector, each yoke having a cartridge support at its distal end for pivotally supporting the razor cartridge.

3. The shaving system of claim 2, wherein the yokes each have a cartridge return spring for engaging the cartridge to bias the cartridge to a predetermined position.

4. The shaving system of claim 1, wherein the handle body has an elastomeric grip.

5. The shaving system of claim 1, wherein the bottom wall has a slot, and the extension has a raised rib for fitting into the slot for guiding the extension into engagement with the bottom wall.

6. The shaving system of claim 1, wherein the bottom wall is curved, and the extension is curved to mate with the bottom wall.

7. The shaving system of claim 1, wherein the connector mounting portion of the handle body has an upper front portion opposed to the bottom wall, and the handle attachment portion of the connector has a central portion for bearing against the upper front portion of the connector mounting portion to stabilize the connector on the handle.

8. The shaving system of claim 7, wherein the upper front portion and the bottom wall are curved, and the central portion and the extension of the connector are curved to mate with the upper front portion and the bottom wall, respectively.

9. The shaving system of claim 1, further comprising a release button slidably mounted to the connector mounting portion of the handle body, the button having a cam for engaging the cantilever latch such that when the button is slid forward from an initial position, the cam pushes against the cantilever latch to raise the engagement portion of the latch above the connector wall to release the connector from the handle.

10. The shaving system of claim 9, comprising a button return spring operably connected to the handle body and the release button for biasing the button to the initial position.

11. The shaving system of claim 10, wherein the button return spring is a substantially vertical cantilever spring rigidly attached at one end to the handle body.

12. The shaving system of claim 9, wherein the connector mounting portion of the handle body has a pair of spaced-apart tracks for slidably mounting the release button.

13. The shaving system of claim 12, wherein the release button has a pair of guides for engaging the tracks, and each guide has a retaining tab for engaging a groove on the underside of one of the tracks for retaining the button on the connector mounting portion of the handle body.

14. The shaving system of claim 11, wherein the cantilever latch, the button return spring, and a pair of spaced-apart tracks for slidably mounting the release button are integrally formed as a latch structure rigidly attachable to the handle body.

15. A connector for supporting a razor cartridge, and for connecting to a handle to form a shaving system, the handle having a handle body and a connector mounting portion at the front of the handle body, the connector mounting portion having a substantially horizontal bottom wall and an inwardly-extending cantilever latch that is elastically deformable in a substantially vertical direction, the cantilever latch including a protruding engagement portion;

the connector comprising:

a central body, a cartridge mounting structure extending forward from the central body for supporting the razor cartridge, and a handle attachment portion extending rearward from the central body, the handle attachment portion having an extension for slidingly mating with the bottom wall of the connector mounting portion of the handle, and the handle attachment portion further having a substantially vertical connector wall at its free end for engaging and deflecting the cantilever latch upward as the extension is slidingly engaged with the bottom wall, until the engagement portion of the cantilever latch snaps over the connector wall to removably retain the connector on the handle between the bottom wall of the connector mounting portion and the cantilever latch wherein when the engagement portion of the cantilever latch snaps over the connector, at least a portion of the cantilever latch is concealed by the connector which forms a part of external surfaces of the shaving system.

16. The connector of claim 15, wherein the cartridge mounting structure comprises a pair of yokes extending forward from the central body of the connector, each yoke having a cartridge support at its distal end for pivotally supporting the razor cartridge.

17. The connector of claim 16, wherein the yokes each have a cartridge return spring for engaging the cartridge to bias the cartridge to a predetermined position.

18. The connector of claim 15, wherein the bottom wall of the connector mounting portion of the handle body has a slot, and the extension has a raised rib for fitting into the slot for guiding the extension into engagement with the bottom wall.

19. The connector of claim 15, wherein the connector mounting portion of the handle body has an upper front portion opposed to the bottom wall, and the handle attachment portion of the connector has a central portion for bearing against the upper front portion of the connector mounting portion to stabilize the connector on the handle.

20. The connector of claim 19, wherein the upper front portion and the bottom wall are curved, and the central portion and the extension of the connector are curved to mate with the upper front portion and the bottom wall, respectively.

* * * * *